United States Patent [19]

Bridges et al.

[11] Patent Number: 4,476,926

[45] Date of Patent: Oct. 16, 1984

[54] METHOD AND APPARATUS FOR MITIGATION OF RADIO FREQUENCY ELECTRIC FIELD PEAKING IN CONTROLLED HEAT PROCESSING OF HYDROCARBONACEOUS FORMATIONS IN SITU

[75] Inventors: Jack E. Bridges, Park Ridge; Allen Taflove, Wilmette, both of Ill.

[73] Assignee: IIT Research Institute, Chicago, Ill.

[21] Appl. No.: 363,765

[22] Filed: Mar. 31, 1982

[51] Int. Cl.[3] ..... E21B 36/04; E21B 43/24

[52] U.S. Cl. ..... 166/248; 166/60; 166/65 R

[58] Field of Search ..... 166/248, 302, 60, 65 R; 299/2

[56] References Cited

U.S. PATENT DOCUMENTS

| | | | |
|---|---|---|---|
| 2,757,738 | 8/1956 | Ritchey | 166/60 X |
| 2,829,190 | 4/1958 | Comlossy, Jr. | 166/65 R X |
| 2,939,689 | 6/1960 | Ljungstrom | 166/60 X |
| 3,211,220 | 10/1965 | Sarapuu | 166/65 R X |

FOREIGN PATENT DOCUMENTS

| | | | |
|---|---|---|---|
| 756582 | 9/1956 | United Kingdom | 166/248 |

*Primary Examiner*—George A. Suchfield
*Attorney, Agent, or Firm*—Fitch, Even, Tabin & Flannery

[57] ABSTRACT

The effects of radio frequency electric field peaking in the earth formations surrounding a conductor excited by radio frequency energy in the controlled in situ heat processing of hydrocarbonaceous earth formations are mitigated by providing an inert buffer region around the conductor to which radio frequency electromagnetic energy is supplied to produce an electric field within the earth formations. A portion of the earth formations is removed to accommodate insertion of the conductor at a desired location in the earth formations and to provide a buffer region between the conductor and the surrounding earth formations. The conductor is supported at the desired location in spaced relationship to the surrounding earth formations, the buffer region encompassing the principal region of the electric field enhancement region around the conductor where the probability of breakdown in the earth formations over the period of application of the radio frequency energy would be above a tolerable level. The buffer region is filled with dielectric material having an electric field breakdown level greater than that of the surrounding earth formation medium such that the probability of breakdown in the buffer region over the period of application of the radio frequency energy is tolerable. Preferably the filler medium has a power dissipation characteristic less than that of the surrounding earth formations.

51 Claims, 12 Drawing Figures

ROW 1
ROW 2
ROW 3
6
12
10
10a
14a
14c
14
14d
14b
16
2.
3.

20
18
12
10
14
16
HYDROCARBONACEOUS DEPOSIT 8
6
L
BARREN ROCK 26
24
22

20
18
14a
14c
10
14
14d
14b
6
10a
HYDROCARBONACEOUS DEPOSIT 8
50
L
10
22
24
BARREN ROCK 26

Fig. 4.
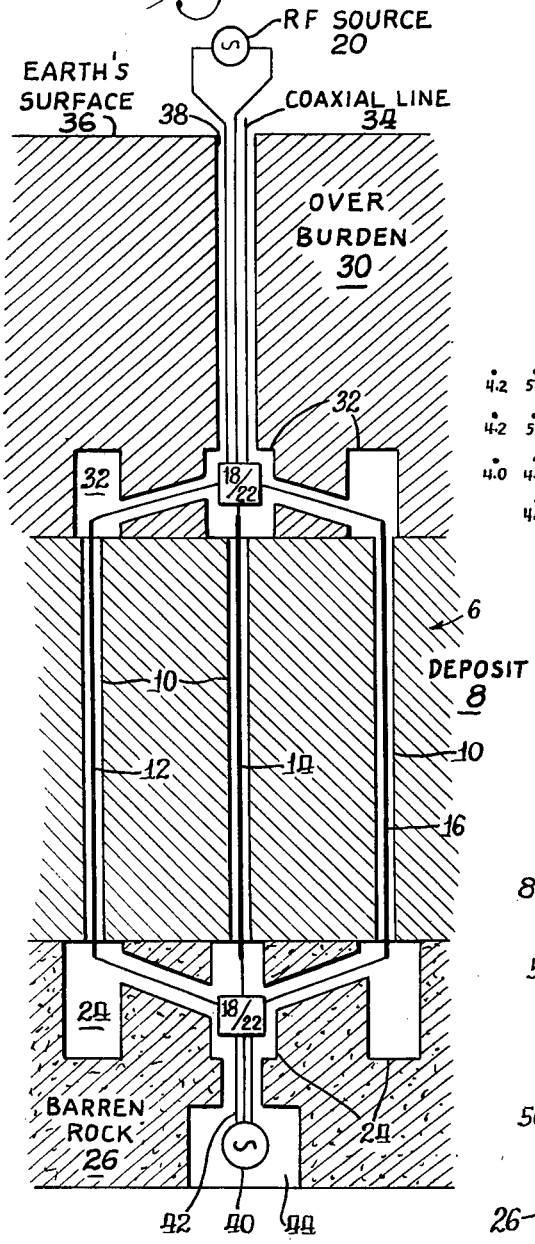
Fig. 5.
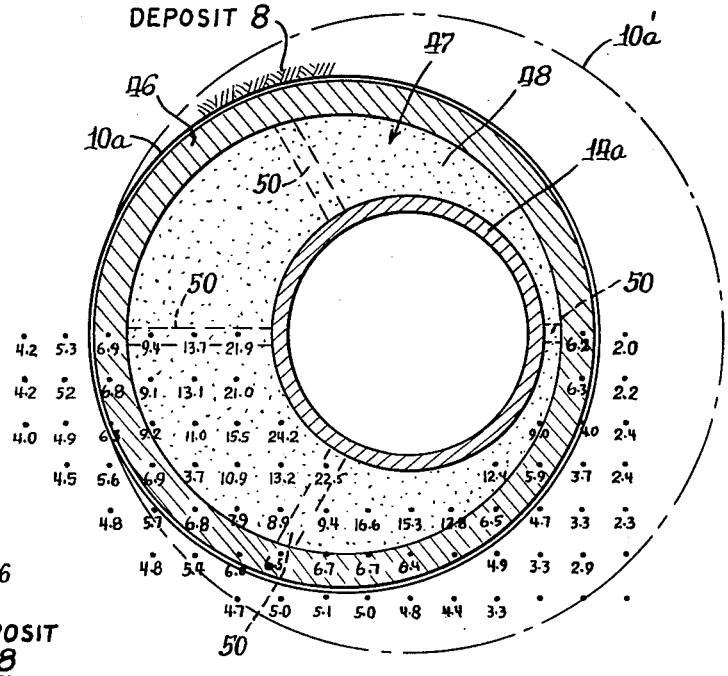
Fig. 6.
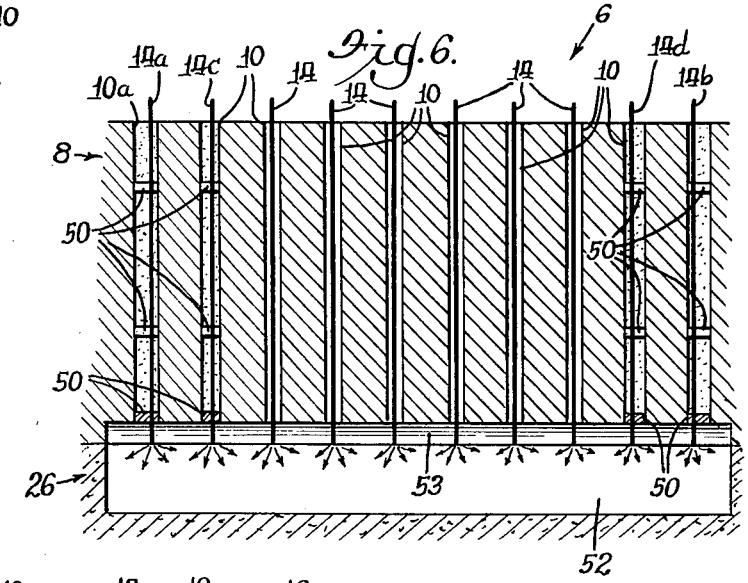
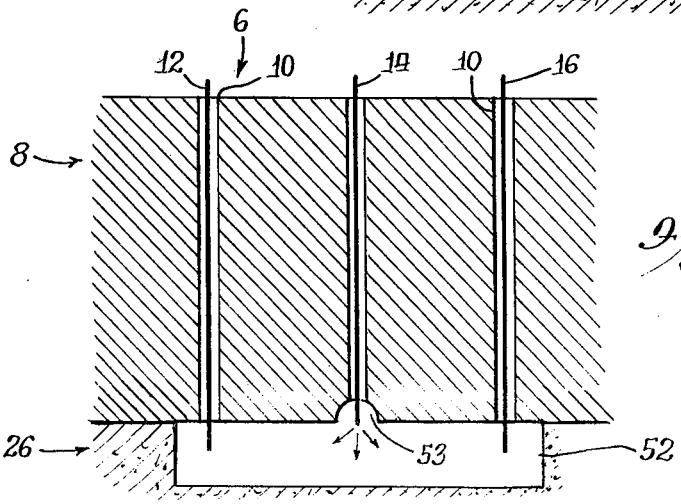
Fig. 7.

METHOD AND APPARATUS FOR MITIGATION OF RADIO FREQUENCY ELECTRIC FIELD PEAKING IN CONTROLLED HEAT PROCESSING OF HYDROCARBONACEOUS FORMATIONS IN SITU

BACKGROUND OF THE INVENTION

This invention relates generally to the recovery of marketable products such as oil and gas from hydrocarbon bearing deposits such as oil shale or tar sand by the application of electromagnetic energy to heat the deposits. More specifically the invention relates to a method and system including use of a high power radio frequency signal generator and an arrangement of elongated electrodes, inserted in the earth formations for applying electromagnetic energy to provide controlled heating of the formations. Still more specifically, the invention relates to the mitigation of the effects of radio frequency electric field peaking in the electromagnetic heating of hydrocarbonaceous earth formations, as at excitor electrodes.

Materials such as oil shale, tar sands, and coal are amenable to heat processing to produce gases and hydrocarbonaceous liquids. Generally, the heat develops the porosity, permeability and/or mobility necessary for recovery. Oil shale is a sedimentary rock which, upon pyrolysis or distillation, yields a liquid, referred to as shale oil, and non-condensable gaseous hydrocarbons. The liquid may be refined into products which resemble petroleum products. Tar sand is an erratic mixture of sand, water and bitumen with the bitumen typically present as a film around water-enveloped sand particles. Using various types of heat processing, the bitumen can be separated. Also, as is well known, coal gas and other useful products can be obtained from coal using heat processing.

In the destructive distillation of oil shale or other solid or semi-solid hydrocarbonaceous materials, the solid material is heated to an appropriate temperature, and the emitted products are recovered. The desired organic constituent of oil shale, known as kerogen, constitutes a relatively small percentage of the bulk shale material, so very large volumes of shale need to be heated to elevated temperatures in order to yield relatively small amounts of useful end products. The handling of the large amounts of material is in itself a problem, as is the disposal of wastes. Also, substantial energy is needed to heat the shale, and the efficiency of the heating process and the need for relatively uniform and rapid heating have been limiting factors on success. In the case of tar sands, the volume of material to be handled, as compared to the amount of recovered product, is again relatively large, since bitumen typically constitutes only about ten percent of the total by weight. Material handling of tar sands is particularly difficult even under the best of conditions, and the problems of waste disposal are, of course, present here as well.

A number of proposals have been made for in situ methods of processing and recovering valuable products from hydrocarbonaceous deposits. Such methods may involve underground heating or retorting of material in place, with little or no mining or disposal of solid material in the formation. Valuable constituents of the formation, including heated liquids of reduced viscosity, may be drawn to the surface by a pumping system or forced to the surface by injecting another substance into the formation. It is important to the success of such methods that the amount of energy required to effect the extraction be minimized.

It has been known to heat relatively large volumes of hydrocarbonaceous formations in situ using radio frequency energy. This is disclosed in Bridges and Taflove U.S. Reissue Pat. No. Re. 30,738. That patent discloses a system and method for in situ heat processing of hydrocarbonaceous earth formations wherein a plurality of conductive means are inserted in the formations and bound a particular volume of the formations. As used therein, the term "bounding a particular volume" was intended to mean that the volume was enclosed on at least two sides thereof. In the most practical implementations, the enclosed sides were enclosed in an electrical sense, and the conductors forming a particular side could be an array of spaced conductors. Electrical excitation means were provided for establishing alternating electric fields in the volume. The frequency of the excitation means was selected as a function of the dimensions of the bounded volume so as to establish a substantially non-radiating electric field which was substantially confined in such volume. In this manner, volumetric dielectric heating of the formations occurred to effect approximately uniform heating of the volume.

In the preferred embodiment of the system described in that patent, the frequency of the excitation was in the radio frequency range and had a frequency between about 100 KHz and 100 MHz. In that embodiment, the conductive means comprised conductors disposed in respective opposing spaced rows of boreholes in the formations. One structure employed three spaced rows of conductors which formed a triplate-type of waveguide structure. The stated excitation was applied as a voltage, for example, across different groups of the conductive means or as a dipole source, or as a current which excited at least one current loop in the volume. Particularly as the energy was coupled to the formations from electric fields created between respective conductors, such conductors were, and are, often referred to as electrodes.

SUMMARY OF THE INVENTION

The present invention is an improvement upon the system and method described in U.S. Reissue Pat. No. Re. 30,738, and may utilize the same sort of waveguide structure, preferably in the form of the same triplate transmission line. The teachings of that reissue patent are hereby incorporated herein by reference.

The present invention relates to the mitigation of the effects of radio frequency electric field peaking that occurs in electromagnetic heating with systems and methods such as those disclosed in the reissue patent. More particularly, near the electrodes, especially near certain excitor electrodes of a triplate line array as shown in the reissue patent used to achieve in situ heating of oil shale or tar sand, it is possible to generate unwanted high levels of radio frequency (RF) electric fields and consequent heating. These high levels can occur because the electric field lines originate at the finite circumference of each excitor electrode, causing the lines to become crowded, and thus, enhanced. Electric field enhancement causes overheating of the local medium, thus reducing the energy application efficiency, one of the hallmarks of the triplate line. Further, electric field enhancement places greater stress upon the local medium and may encourage dielectric breakdown. Under certain circumstance, such breakdown could be catastrophic to the RF heating process. Mitigation of electric field enhancement according to the present invention provides a greater safety margin for operation of the triplate electrode array, especially for large scale arrays using widely spaced electrodes of relatively small diameter.

In accordance with the present invention, the described mitigation is achieved by surrounding the electrode of interest with a buffer region of air or other electrically inert filling medium, such as quartz sand. In this manner, the region of electric field peaking near the electrode falls within the buffer region. The buffer region medium is not appreciably heated by the high fields, and does not have such great problems with dielectric breakdown. If the buffer region medium is selected to have the real part of its permittivity similar to that of the surrounding earth formations, distortion of the overall triplate electric field distribution is reduced. The inert buffer medium may be contained within a borehole having a diameter larger than the electrode of interest, so that the electrode is surrounded by the inert material. The electrode may be located either concentrically within the larger borehole, or eccentrically, depending upon the nature of the distribution of the electric field about the electrode, so that the peak field region is substantially contained within the electrically inert buffer material. The inert buffer material may be kept from touching the surrounding formations by lining the borehole with a thin casing of inert material that is impermeable to fluid flow and capable of surviving at high temperatures. This prevents passage of oil from the surrounding region to the inert material, avoiding possible heating and breakdown late in the RF heating process.

The problem of excessive electric fields at the surface of a conductor has been encountered for conductors located in air above ground, such as 60 Hz AC power transmission wires and high voltage bus bars in substations, as well as high frequency high voltage points in antennas, and Van de Graaff and other high voltage generators and particle accelerators. There, the problem area was one of corona generation in air and complete breakdown (sparkover) of air. The means of mitigating these phenomena has been widely reported and used. The radius of curvature or effective radius of curvature of the high voltage conductor in question was increased to decrease the crowding of the electric field lines at the surface of the conductor. For power transmission lines, this has meant the use of either large diameter individual wires or bundled wires at a common phase to realize an equivalent very large diameter circular conductor. For other high voltage situations, the terminals or bus bars have been designed to have very smooth shapes with large radii of curvature.

Although it is possible to mitigate the effects of electric field peaking at the excitor electrodes of a triplate line in situ by following the above ground practices and simply increasing the diameter of each excitor electrode to a point where some acceptable value is achieved, this approach would lead to the need for large diameter boreholes and electrodes, which is undesirable from feasibility and cost viewpoints.

In accordance with the present invention, the effects of electric field peaking at triplate excitor electrodes can be mitigated without increasing the diameter of the excitor electrodes, even permitting a decrease in the diameter of the excitor electrodes, if justified from an economic viewpoint. The present invention, in fact, teaches that the use of inert buffer regions surrounding the excitor electrodes produces a greater level of mitigation of the effects of peak fields than does the use of equivalent diameter boreholes with electrode diameters chosen large enough to fill each borehole.

Thus, one aspect of the present invention is to provide mitigation of the effects of radio frequency electric field peaking in the controlled electromagnetic heat processing of hydrocarbonaceous formations in situ by providing an inert buffer region around a conductor to which radio frequency electromagnetic energy is supplied for generating an electric field within the surrounding earth formations, most particularly around certain of the excitor electrodes of a triplate array. A portion of the earth formations is removed to accommodate insertion of the conductor at a desired location in the earth formations and to provide a buffer region between the conductor and the surrounding earth formations. The conductor is supported at the desired location in spaced relationship to the surrounding earth formations, the buffer region encompassing all of the electric field enhancement region around the conductor where the probability of breakdown in the earth formations over the period of application of the radio frequency energy would be above a tolerable level. The buffer region is filled with dielectric material having an electric field breakdown level greater than that of the surrounding earth formation medium such that the probability of breakdown in the buffer region over the period of application of the radio frequency energy is tolerable.

This and other aspects, objects and advantages of the present invention will become apparent from the following detailed description, particularly when taken in conjunction with the accompanying drawings.

BRIEF DESCRIPTION OF THE DRAWINGS

FIG. 4 is a vertical sectional view, partly diagrammatic, of another embodiment of the present invention having electromagnetic energy applied at both ends of the waveguide structure, the view corresponding to the section taken in FIG. 2;

FIG. 5 is an enlarged horizontal sectional view of an end excitor electrode portion of the triplate structure illustrated in FIG. 1;

FIG. 6 is a vertical sectional view comparable to FIG. 3 of another embodiment of the present invention, providing mitigation of tip field peaking;

FIG. 7 is a vertical sectional view comparable to FIG. 2 of the embodiment shown in FIG. 6;

DETAILED DESCRIPTION OF PREFERRED EMBODIMENTS

Figure 1:
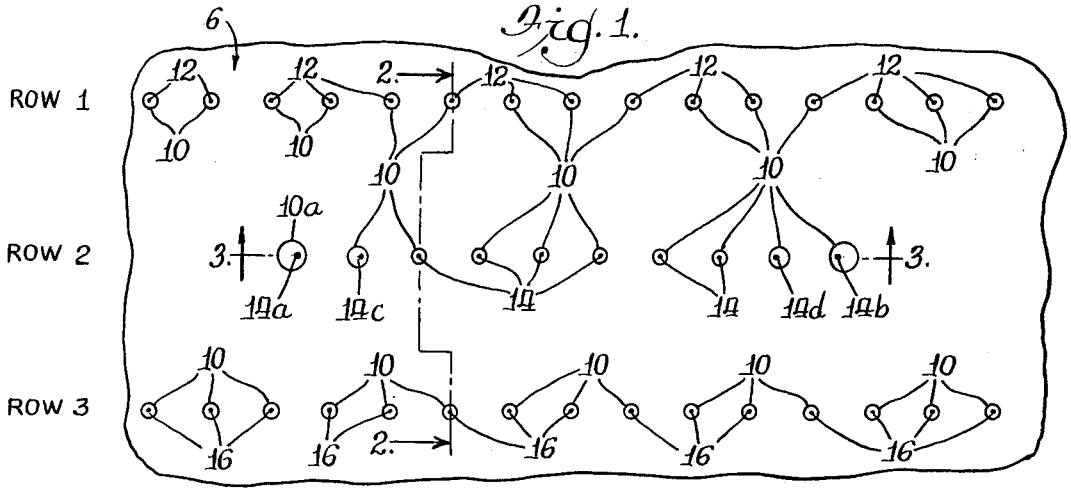
FIG. 1 is a plan view of a triplate waveguide structure disposed in earth formations in accordance with an embodiment of the present invention.
Figure 2:
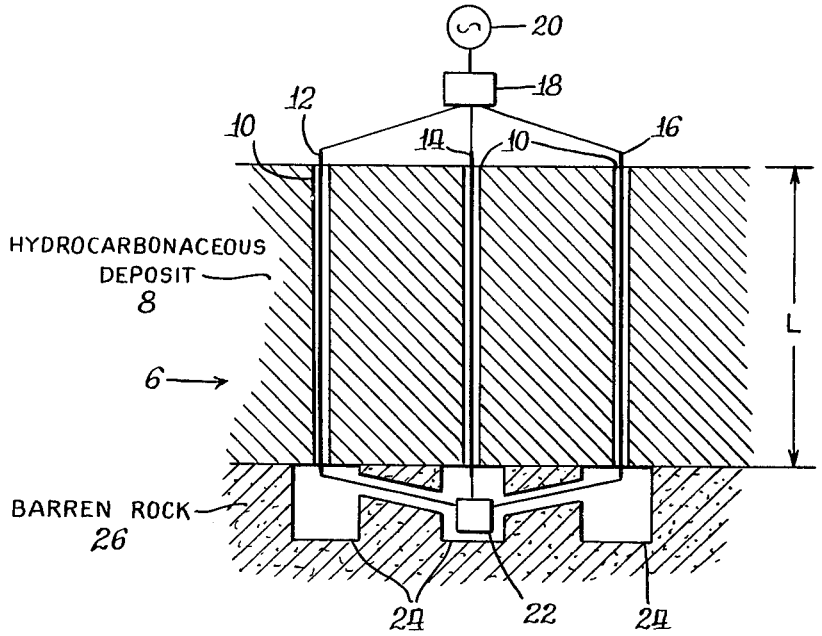
FIG. 2 is a vertical sectional view, partly diagrammatic, of the structure illustrated in FIG. 1, taken along line 2—2 in FIG. 1.
Figure 3:
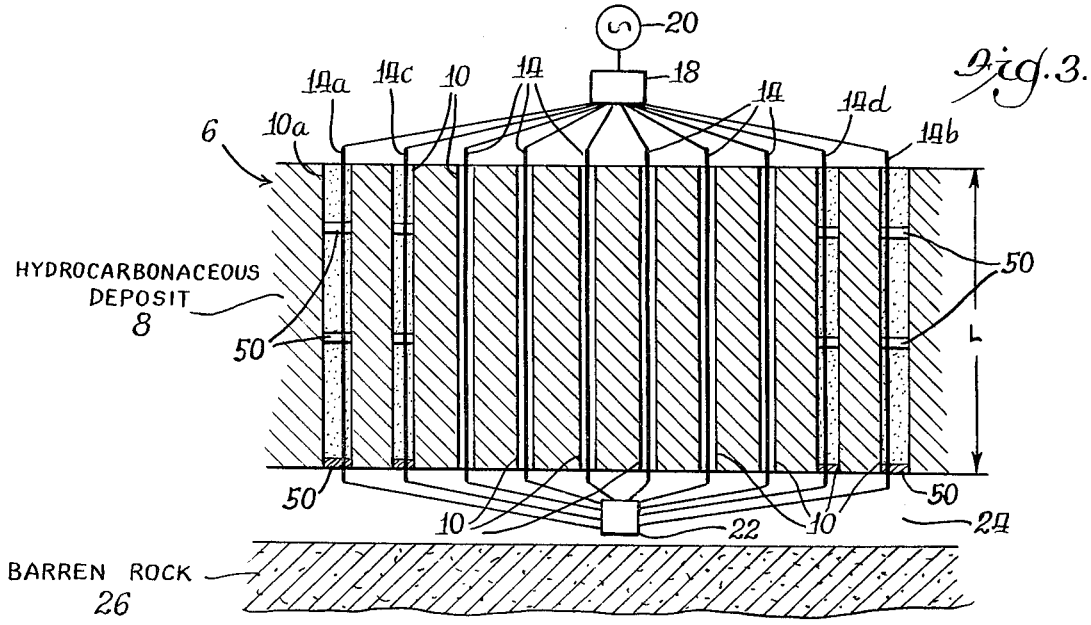
FIG. 3 is a vertical sectional view, partly diagrammatic, of the structure illustrated in FIG. 1, taken along line 3—3 in FIG. 1.

The present invention will be described primarily in respect to its application to a triplate waveguide structure as disclosed in Bridges and Taflove U.S. Reissue Pat. No. Re. 30,738. In FIGS. 1, 2 and 3 there is illustrated a simplified construction of one form of the present invention as applied to a triplate waveguide structure 6 similar to the structure as shown in FIGS. *4a*, *4b* and *4c* of the reissue patent utilizing rows of discrete electrodes to form the triplate structure. The most significant difference between the system illustrated in FIGS. 1, 2 and 3 herein and that illustrated in the reissue patent is in the termination of the waveguide structure at its lower end.

FIG. 1 shows a plan view of a surface of a hydrocarbonaceous deposit 8 having three rows 1, 2, 3 of boreholes 10 with elongated tubular electrodes 12, 14, 16 placed in the boreholes of respective rows. The individual elongated tubular electrodes 12, 14, 16 are placed in respective boreholes 10 that are drilled in relatively closely spaced relationship in three straight and parallel rows 1, 2, 3, the central row 2 flanked by rows 1 and 3. Electrodes 12 are in row 1, electrodes 14 in row 2, and electrodes 16 in row 3. The rows are spaced far apart relative to the spacing of adjacent electrodes of a row. FIG. 2 shows one electrode of each row. FIG. 3 illustrates the electrodes 14 of the central row, row 2.

In the embodiment shown, the boreholes 10 are drilled to a depth L into the formations, where L is the approximate depth of the bottom boundary of the hydrocarbonaceous deposit 8. After insertion of the electrodes 12, 14, 16 into the respective boreholes 10, the electrodes 14 of row 2 are electrically connected together and coupled to one terminal of a matching network 18. The electrodes 12, 16 of the flanking outer rows are also connected together and coupled to the other terminal of the matching network 18. Power is applied to the waveguide structure 6 formed by the electrodes 12, 14, 16, preferably at radio frequency. Power is applied to the structure from a power supply 20 through the matching network 18, which acts to match the power source 20 to the waveguide 6 for efficient coupling of power into the waveguide. The lower ends of the electrodes are similarly connected to a termination network 22 which provides appropriate termination of the waveguide structure 6 as required in various operations utilizing the present invention. As the termination network 22 is below ground level and cannot readily be implanted or connected from the surface, lower drifts 24 are mined out of the barren rock 26 below the deposit 8 to permit access to the lower ends of the electrodes 12, 14, 16, whereby the termination network 22 can be installed and connected.

The zone heated by applied energy is approximately that bounded by the electrodes 12, 16. The electrodes 12, 14, 16 of the waveguide structure 6 provide an effective confining waveguide structure for the alternating electric fields established by the electromagnetic excitation. The outer electrodes 12, 16 are commonly referred to as the ground or guard electrodes, the center electrodes 14 being commonly referred to as the excitor electrodes. Heating below L in minimized by appropriate termination of the waveguide structure at the lower end.

The use of an array of elongated cylindrical electrodes 12, 14, 16 to form a field confining waveguide structure 6 is advantageous in that installation of these units in boreholes 10 is more economical than, for example, installation of continuous plane sheets on the boundaries of the volume to be heated in situ. To achieve field confinement, the spacing between adjacent electrodes of a respective row should be less than about a quarter wavelength and, preferably, less than about an eighth of a wavelength.

Very large volumes of hydrocarbonaceous deposits can be heat processed using the described technique, for example, volumes of the order of $10^5$ to $10^6 m^3$ of oil shale. Large blocks can, if desired, be processed in sequence by extending the lengths of the rows of boreholes 10 and electrodes 12, 14, 16. Alternative field confining structures and modes of excitation are possible. Further field confinement can be provided by adding conductors in boreholes at the ends of the rows to form a shielding structure.

In FIGS. 1 to 3 it was assumed, for ease of illustration, that the hydrocarbonaceous earth formations formed a seam at or near the surface of the earth, or that any overburden had been removed. However, it will be understood that the invention is equally applicable to situations where the resource bed is less accessible and, for example, underground mining is required both above and below the deposit 8. In FIG. 4 there is shown a condition wherein a moderately deep hydrocarbonaceous bed 8, such as an oil shale layer of substantial thickness, is located beneath an overburden 30 of barren rock. In such instance, upper drifts 32 can be mined, and boreholes 10 can be drilled from these drifts. Again, each of these boreholes 10 represents one of a row of boreholes 10 for a triplate-type configuration as is shown in FIG. 3. After the boreholes 10 have been drilled, respective tubular electrodes 12, 14, and 16 are lowered into the boreholes 10 in the resource bed 8. Coaxial lines 34 carry the energy from the power supply 20 at the surface 36 through a borehole 38 or an adit to the matching network 18 in a drift 32 for coupling to the respective electrodes 12, 14, 16. In this manner, there is no substantial heating of the barren rock of the overburden 30.

FIG. 4 illustrates an alternative embodiment of the present invention in that provision is made for applying power to the lower end of the triplate line 6 as well as to the upper end. To this end a second power supply 40 is provided at the lower end of the triplate line 6 and is coupled to a matching network 18 by a coaxial cable 42. The second power supply may be located in a drift 24 or in an adjacent drift 44, or it may be located at some distance, even at the surface. Indeed, the same power supply may be used for both ends of the line. In the embodiment shown in FIG. 4, a termination network 22 and a matching network 18 are supplied at each end of the waveguide structure 6. The termination/matching networks 18, 22 may be of conventional construction for coupling the respective power supplies 20, 40 to the waveguide 6 and, upon switching, for terminating the waveguide with an appropriate impedance. With power applied from the upper power supply 20, the network 18 provides appropriate matching to the line, and the network 22 provides appropriate termination impedance. With power applied from the lower power supply 40, it is the other way around. The appropriate termination impedances will be whatever produces an appropriate phase of a standing wave or other desired property. Terminations for particular standing waves as produce certain desired heating patterns are set forth in the copending United States patent application of the present inventors, Bridges and Taflove, Ser. No. 343,903, filed Jan. 29, 1982. The teachings of that application are hereby incorporated herein by reference.

As stated above, the present invention provides for mitigation of the effects of RF electric field peaking. In the operation of triplate lines as described in the reissue patent, the RF potentials applied to the electrodes 12, 14, 16 produce an electric field within the earth formations. Because power is applied to discrete electrodes, the electric field is concentrated at the electrodes, and maximum heating occurs at the electrodes because of the crowding of field lines. The electric currents necessarily spread out from the electrodes 12, 14, 16 to be relatively uniformly distributed throughout rest of the bounded region. Geometric considerations make the peaking of the electric field greater at the excitor electrodes 14*a* and 14*b* at the respective ends of row 2. The peaking is substantially less at the next to outermost electrodes 14*c*and 14*d*.

There are two related problems occasioned by electric field peaking that result from the dielectric properties of the formations. One is electrical breakdown wherein the high field gradient breaks down the dielectric and channels the current between electrodes. Such breakdown is progressive and once started provides a current channel that precludes even distribution of current and hence heating. The other is caused by the power dissipation characteristic of the formations, typically dominated by the loss tangent, which occasions excessive heating concentrated at the excitor electrodes 14, which in turn produces electrical breakdown.

The power dissipated in any dielectric material is proportional to the product of the frequency, the real part of the permittivity, the loss tangent, and the square of the applied electric field. Within the triplate electrode array, the electric fields are determined not only by the electrode geometry and applied potentials, but also by the spatial distribution of both the real and imaginary parts of the permittivity. Here, where excessive field effects are of general importance, especially when the temperature significantly exceeds 100° C. and the moisture is driven off, the range of the real parts of the permittivities of the various dielectric media is within about an order of a magnitude. Under these circumstances, the earth medium is moderately lossy, and the spatial distribution of the power dissipation is dominated by the loss tangent, since its values vary over several orders of magnitude. Thus, a design goal will be to minimize the dissipation near the electrode by modifying the power dissipation characteristic near the electrode. The power dissipation characteristic is defined here as the property of a given dielectric material to dissipate power in a specified location for the actual geometry and other in situ conditions.

In accordance with the present invention, buffer regions 47 are created about respective excitor electrodes 14 by removing portions of the earth formations to make the boreholes 10 much larger than necessary for containing the electrodes 14, supporting the electrodes 14 at desired locations in spaced relationship to the borehole walls, and filling the intervening buffer space 47 with dielectric filler material 48 having appropriate electrical and mechanical properties. To avoid excessive heating effects in the buffer zone, a material with the smallest loss tangent consistent with other requirements is usually chosen. However, as stated previously, the local power dissipation is also influenced to a lesser extent by other factors, such as the real part of the permittivity. Specifically, the space 47 may be filled with dielectric material having a low or negligible power dissipation characteristic and providing a dielectric breakdown level sufficient to sustain peak electric fields at all expected operating temperatures. Such materials include air, inert gas, ambient product gas, quartz sand, gravel, and high temperature epoxies. Preferably the materials have the real parts of their permittivities substantially the same as that of the surrounding formations so as to reduce distortion of the overall triplate electric field distribution. The dielectric filler material need not be homogenous; indeed, a preferred material is quartz sand and air.

As stated previously, the properties and dimensions of the filler material are chosen to meet the specific goals of this invention. Here, the real part of the permittivity of the filler material should be comparable to, or less than, the real part of the permittivity of the deposit medium, especially at temperatures wherein thermal runaway or dielectric breakdown can occur, that is, above 80° C. and up to 500° C. The real part of the relative permittivity of the filler material at the chosen operating frequencies would range between 1 and 30 at temperatures exceeding 80° C. but no more than 500° C. Similarly, the loss tangents chosen for the filler material would not exceed 0.2, and preferably for commercially available materials range between 0.02 to 0.0001. Such material includes silica, quartz sand, manganese oxide, zinc oxide, and high temperature epoxies. Other dielectrics which have a high value of the real part of the permittivity much greater than that of the deposit have medium or little value here because such large values of the real part of the permittivity tend effectively to enlarge the electrode diameters and thereby defeat a major feature of this invention.

FIG. 5 shows in horizontal cross section an electrode structure for the end electrode 14*a* as utilized in the field testing of a triplate array 6 as shown in FIGS. 1 to 3. In this tested array, there were fifteen electrodes 12 in a row 1 with their centers spaced one foot apart. There were ten electrodes 14 in row 2 with their centers spaced one foot apart. There were fifteen electrodes 16 in row 3 with their centers spaced one foot apart. The centerline of the electrodes 14 of row 2 was 2.5 feet from the centerlines of the electrodes 12, 16 of the flanking rows 1 and 3. The end borehole 10*a* of the center row 2 was of about 6 inch diameter in a tar sand. The end excitor electrode 14*a* was a copper tube 3.25 inches OD with its center offset from the center of the borehole 10*a* by 0.75 inches in the direction toward the other excitor electrodes 14. The borehole 10*a* was lined with a liner 46 made of asbestos cement pipe sold by Johns-Manville Sales Corp. under the trademark Transite. The liner material may be considered part of the dielectric material filling the buffer region 47. The rest of buffer region 47 was filled with quartz sand. In the tested array, the electrode 14*a* was held at its ends relative to the liner 46 while the sand filler was poured in, and then the assembled structure was thrust into the borehole 10*a*. A preferred modification would be to utilize spacers 50 to position the electrode within the liner 46 after the liner 46 is disposed in the borehole 10*a*, with the filler being poured in thereafter. In the event the bottom of the borehole 10*a* is open, the bottom spacer 50 is made imperforate to retain loose dielectric material. It is also possible to operate without the liner 46. The spacers 50 are formed of ceramic or other mateials having desired dielectric properties like those of the filler 48, as such spacers 50 also form part of the dielectric material filling the buffer region 47.

Extensive numerical calculations of the electric field in the illustrated transverse plane near an electrode 14 have been made. The method employed was to consider the field distribution as being principally due to the ordinary transmission line mode (TEM mode), so that a quasi-static analysis could be applied. Assuming equal potential on each excitor electrode 14, and zero potential on each guard electrode 12, 16, this analysis was performed by solving the La Place equation for the potential distribution everywhere within the triplate array 6. Solution was via a finite-difference analog of the La Place equation using the successive over relaxation algorithm. The fields and heating potential were then computed by differentiating the potential distribution. The exact curvature of each electrode was accounted for by having special finite-difference expressions at the grid points nearest the cylindrical electrode surfaces. The La Place equation computer program was run for each test case until convergence of the calculated potentials to within 0.1% everywhere within the triplate arrays.

The resulting $E^2$ distribution is shown in FIG. 5, where the ratio of $E^2/E_o^2$ is shown at points in a square grid for half of the region about the electrode 14*a*, where $E_o^2$ is the square of the nominal electric field at points within the bounded region 28 remote from the electrodes 12, 14, 16.

The particular dimensions of the tested electrode structure shown in FIG. 5 were chosen from electrical and geometrical considerations. As heating is a function of the square of the electric field gradient $E^2$, the distribution of $E^2$ around a 3.25 inch electrode was determined for a volume of uniform permittivity. The values are evenly symmetric about the excitor plane; for electrode 14*b*, the values are mirror-imaged. If the deposit medium 8 were allowed to surround the electrode 14*a* and contact it, the computations indicate that the deposit medium 8 would be subjected to power density peaking factors of up to 24:1 above the nominal, desired level of the electric field-squared, i.e., heating power input would be locally elevated by 24:1. These peaking factors correspond to electric field enhancements of the squareroot of 24:1, or almost 5:1. Overheating and dielectric breakdown is most likely here, as opposed to anywhere else within the triplate array 6.

The distribution of $E^2/E_o^2$ shown in FIG. 5 was then used to select a buffer region 47. Specifically, a buffer region 47 was selected to reduce the $E^2/E_o^2$ peaking factor to 6:1. This was done by drawing the smallest circle that encompassed all points where $E^2/E_o^2$ was greater than 6. This turned out to be a circle approximately 6 inches in diameter centered about 0.75 inches from the center of the electrode 14*a*. It was on this basis that the particular test structure was designed using an oversize 6-inch diameter borehole 10*a* offset by 0.75 inches from the center of the electrode 14*a*. This oversize borehole 10*a* provides an inert buffer region 47 filled with an electrically inert filler 48. The region 47 includes the peak electric field. For the particular buffer region 47 shown, the heating-potential peaking factor that stresses the deposit medium has been reduced to only about 6:1. This is a reduction of 75% from the previous unmitigated case. Corresponding to this, the electric field enhancement stressing the deposit medium has been reduced by about 50% to only about 2.5:1.

It is evident that this mitigation is achieved by any buffer zone 47 that encompasses all of the points where $E^2/E_o^2$ is greater than 6. The illustrated eccentric borehole 10*a* is the smallest cylindrical borehole that achieves this and, hence, is the most economical, removing the least portion of the formations. However, FIG. 5 shows an alternative borehole 10*a'* that also encompasses all such points. The borehole 10*a'* is concentric with the electrode 14*a*. Having the electrode 14*a* centered in the borehole 10*a'* has the practical advantage of making it easier to assemble, as it is easier to keep the electrode centered than offset in a particular direction. However, centering requires a larger borehole 10*a'*, which entails wasteful drilling.

It is also evident from FIG. 5 that the degree of mitigation of the peak heating potential and electric field near the outermost pair of excitor electrodes 14*a*, 14*b*, can be adjusted simply by varying their diameter and shifting the centers of the oversize borehole buffer region 47 surrounding each outer electrode. It should be stated, however, that other electrodes also generate locally enhanced fields. If, in fact, large buffer regions 47 are provided surrounding the outermost pair of excitor electrodes 14*a*, 14*b*, it is possible that the peaking factors near the next to outer excitor electrodes 14*c*, 14*d* can dominate, and provide the first opportunity for dielectric breakdown. If desired, variable buffer region mitigation can be provided for each of the excitor electrodes to achieve an overall bound on the level of field peaking within the triplate line. It can be shown that innermost excitor electrodes 14 would optimally use oversized boreholes that are centered on the electrodes. However, the outer excitor electrodes 14*a*, 14*b* optimally use oversize boreholes that are off-centered, as shown in FIG. 5, because of the nature of the electric field fringing at these electrodes.

The principal alternative to this approach would be to use larger diameter metal electrodes in the enlarged boreholes to increase the radius of electrode curvature and lessen the crowding of the electric field lines. However, besides causing increased cost for the electrodes, this alternative has the disadvantage of yielding less mitigation of the power density and electric field enhancement than the method of the present invention for any given borehole size.

There is a simple reason why use of the buffer region is more effective than the enlarged electrode approach in mitigating electric field peaking. For a selected borehole diameter D and excitor plane potential V relative to the guard planes, the buffer region approach forces the deposit medium 8 to fall in a zone where the potential vis-a-vis the guard planes is less than V. That is, the excitor electrode 14 at potential V is isolated from the nearby deposit medium by the buffer region 47, across which is developed a drop of potential. At the interface between the deposit medium 8 and the buffer zone 47, the potential with respect to the guard planes is therefore less than it would be if the metal electrode completely filled the borehole and forced the interface potential to V. Thus, for a given diameter D (equivalently, a given borehole circumference), there is less field-line crowding with the lower potential, buffer region approach.

Figure 8:
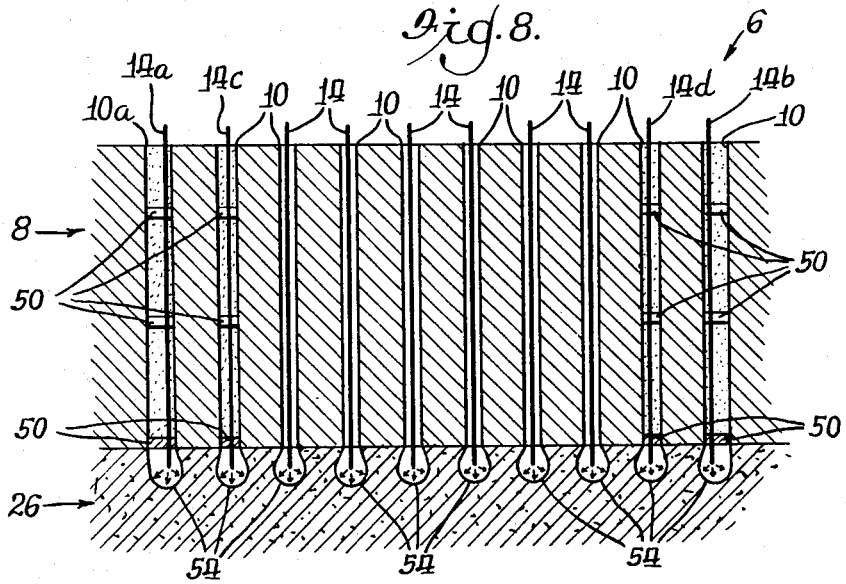
FIG. 8 is a vertical sectional view comparable to FIG. 3 of still another embodiment of the present invention, also providing mitigation of tip field peaking.
Figure 9:
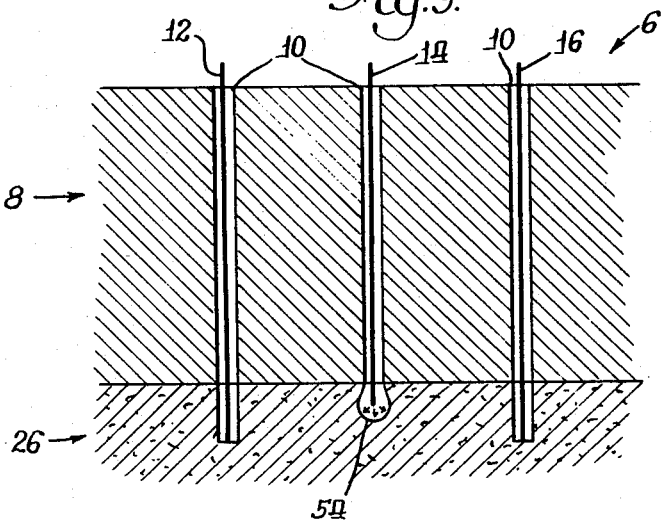
FIG. 9 is a vertical sectional view comparable to FIG. 2 of the embodiment shown in FIG. 8.

The buffer region concept can also be applied to limit the stress of peaked electric fields upon the deposit medium 8 at the ends of the excitor electrodes 14. At the end of each excitor electrode 14 the peaking of the fringing fields can reach the high level noted for transverse field peaking at the outermost excitor electrodes 14a, 14b already discussed. As shown in FIGS. 6 and 7, one way of implementing the buffer region approach for mitigating the effects of tip field peaking is to terminate all excitor electrodes 14 in a mined opening such as a drift 52. This was the arrangement used in the tests utilizing the structure of FIG. 5 as mentioned above. Here, the high field regions near the ends of the electrodes 14 are isolated from the surrounding deposit medium 8. Preferably, the buffer regions are formed in part by a hollowed out portion 53 around the tips of the electrodes 14 at the roof of the drift 52. Alternatively, as shown in FIGS. 8 and 9, for each excitor electrode 14 not intended to terminate in a drift 52, but instead dead-ending in a borehole 10, a tip buffer region 47 can be provided by hollowing out a roughly cylindrical volume at the planned location of the electrode tip, and filling it with an electrically inert material.

The buffer region concept can also be extended to limit the stress of peaked electric fields upon the deposit medium 8 at other high field zones such as feed points of buried dipoles, loops or antennas. For example, in addition to exciting the triplate line by connecting the RF power source to the center row of conductors, the triplate line or similar enclosed structures can be excited by means of electrode pairs, dipoles, coils, current loops or antennas. A volume of the deposit medium 8 surrounding the feed point or other high field zone may be excavated or drilled out. The buffer region is then filled with an electrically inert material. As with the earlier examples, the deposit medium 8 thus has strictly limited electric potentials with respect to either other electrodes or the remote earth, and thus limited electric field enhancement. Earth media near any discontinuities of the conductor geometry, such as corners, bends, edges, ends, slots or ridges, can be similarly treated.

Tip field and feed regions can be provided with buffer zones either by directly mining cavities surrounding these regions, or by using down borehole tools to enlarge borehole diameters appropriately. Any of a number of well-known underreaming processes may be used, such as those using water jets carrying sand. The resulting buffer regions can be filled with air, inert gas, ambient product gas, quartz sand, gravel, high temperature epoxy, etc., as discussed earlier, subject to dielectric breakdown safety margin requirements. Mined regions can be provided with refractory cement liners, if desired, for mechanical support or to prevent product accumulation.

The use of the buffer region concept can impact both the electric field distribution and wave propagation constant of a triplate electrode array 6. The buffer regions 47 surrounding the electrodes 14a, 14b of concern are essentially insulating in nature. At the frequencies of interest for in situ processing of oil shale and tar sand (100 kHz and above), the principal effects of insulating the excitor electrodes are to distort the nominal transverse electric fields (displacement currents), introduce longitudinal fields (non TEM), and alter the observed bulk propagation constant. The effects can lead to less uniformity of heating of the deposit, less control over standing wave correction, and more radiation. All of these effects are undesirable.

To minimize these undesirable effects, the size of the buffer regions 47 should be limited to only that needed to achieve the proper field peaking levels. Further, the material used to fill the buffer regions is preferably chosen to have an electrical permittivity comparable to that of the surrounding deposit medium.

The use of the buffer region concept serves to suppress the formation and propagation of dielectric breakdown paths in the surrounding deposit medium 8. As already discussed, the buffer region 47 isolates the medium 8 from the high field zone local to the excited metal electrode 14a. There is an additional mechanism which serves to suppress incipient breakdown paths. This mechanism is best illustrated by reference to the equivalent circuit shown in FIG. 10a for the fields and medium 8 near a high potential excitor electrode 14a surrounded by a buffer region 47.

Figure 10A:
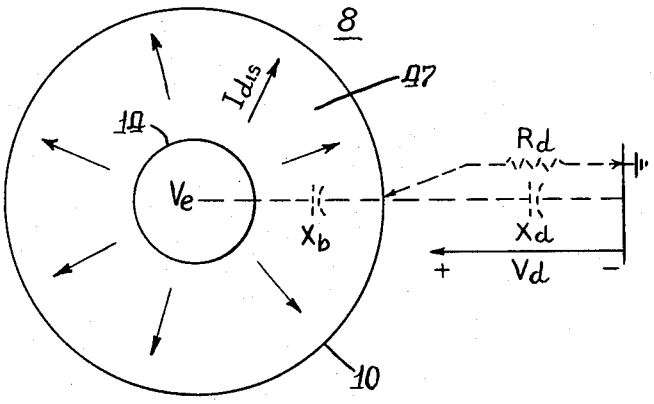
FIGS. 10*a*, 10*b* and 10*c* are diagrammatic illustrations of equivalent circuits for the electrode structures of the present invention, showing the effect of incipient breakdown.
Figure 10B:
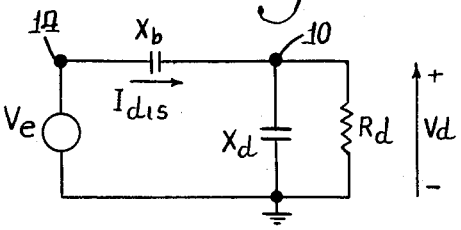

In FIG. 10b, a voltage source $V_e$ is identified with the excitor electrode 14a of interest. The series capacitive reactance $X_b$ is identified with the series loading action of the buffer region 47, or insulating sheath, about the electrode 14a. The parallel capacitive reactance $X_d$ and resistance $R_d$ represent the loading action of the deposit medium 8. The ground represents the ground plane locus of rows 1 and 3. Finally, the loop current $I_{dis}$ is identified with the displacement current sourced locally by the excitor electrode 14a.

Figure 10C:
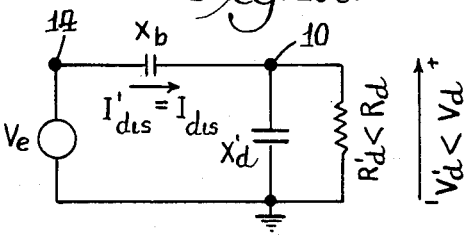

FIG. 10b shows that the displacement current sourced by the excitor electrode 14a and passing through the buffer region 47 serves to set up a potential across both the reactive and loss components of the equivalent impedance identified with the deposit medium 8. If an incipient dielectric breakdown path is present, as shown in FIG. 10c, the resistance $R_d$ and reactance $X_d$ can be expected to drop. But, the action of the series reactance $X_b$ is to limit the current sourced by the electrode 14a (especially if $X_b$ is large), so that the potential developed across $R_d$ and $X_d$ will decrease. This action serves to diminish the electric field across the incipient breakdown path and may be sufficient either to suppress the breakdown completely or to extinguish it after onset. It should be noted, however, that the salutary effects of a high value of $X_b$ for suppressing breakdown may conflict with the field distortion effect of the buffer region 47 as discussed above. That is, to achieve a large $X_b$, the buffer region 47 should either be large in extent or filled with a material having a small relative dielectric constant. Nevertheless, the presence of any finite $X_b$ due to the use of a buffer region 47 about the excitor electrode 14a does help to suppress dielectric breakdown of the surrounding deposit medium 8.

The use of the buffer region concept can also serve to suppress the onset of a local thermal runaway condition in the high-field region near an excitor electrode 14. Runaway can be defined as an uncontrolled effect due to a positive feedback mechanism between temperature and the power dissipation characteristic. For example, a runaway might occur in a local deposit zone 8 under constant electric field conditions where an initial temperature rise causes an increased power dissipation characteristic, which causes more electromagnetic energy to be dissipated, which causes a further increase in temperature, and so on.

From the considerations presented in connection with FIGS. 10a, 10b and 10c, it may be seen that the onset of runaway would cause the equivalent deposit reactance $X_d$ and loss resistance $R_d$ to decrease, indicating greater power dissipation for a given electric field in the deposit. Yet, analogous to the breakdown suppression considerations, the presence of $X_b$ limits the displacement current sourced by the excitor electrode 14a and thus causes the voltage (field) across $R_d$ (when $X_d$ and $R_d$ drop) to drop to limit the power dissipated by $R_d$. This is really a negative feedback mechanism which competes with the positive feedback needed for runaway, and helps to suppress this phenomenon.

The design of a mitigating structure for electromagnetic heat processing of particular hydrocarbonaceous formations depends upon a number of factors including economic factors and the properties of the particular formations. The average, or nominal, RF power density within the triplate array is determined by the desired final process temperature and the desired heating time to this temperature. The final process temperature and the heating time are in turn determined by the hydrocarbon product mix desired as well as a computation of return on investment. Given the final deposit temperature and the heating time, the average RF power density is approximately equal to the deposit heat requirement (enthalpy) divided by the heating time.

The distribution of the RF power density peaking factors relative to the nominal power density is determined by the number of electrodes, 12, 14, 16, the diameters of the electrodes, the shape of the electrodes, the spacing of the electrodes 12, 14, 16 in each row of the triplate array 6, and the spacing of the rows of the triplate lines 6. These factors are in turn determined by the desired RF radiation suppression, heating uniformity in the transverse plane, and labor and materials costs for electrodes, boreholes, and drilling. For a given electrode configuration, numerical modelling or scale modelling may be used to map the field peaking factors near the excitor electrodes 14, at the tips of the excitor electrodes 14, or at any other high electric field zones. With the peaking factors mapped out, the absolute RF power density distribution may be obtained simply by multiplying the peaking factors by the average (nominal) power density within the triplate line 6.

The dielectric breakdown characteristics of the deposit medium are determined by laboratory or field measurements of samples subjected to a wide range of RF power densities over the expected heating time of the deposit. Since a spread of breakdown characteristics is expected, a statistical analysis may be performed to determine what RF power density is normally sustainable by the deposit medium without breakdown over the expected heating time. Operation of the deposit medium at a peak absolute power density equal to the maximum permitted by this criterion must not yield dielectric breakdown with more than some tolerable probability. This tolerable probability is determined from both economic and technical considerations. First, the cost of a failure must be accounted. Second, the cost of oversize buffer regions must be accounted. And third, the impact of oversize buffer regions upon electric field uniformity, radiation, and standing wave correction control must be accounted.

Given the above information, the buffer regions 47 are designed to contain all points within the triplate line 6 having absolute RF power densities greater than the maximum permitted by the selected safety margin. The absolute RF power density distribution can be used directly to draw the bounding locus (in three dimensions) of the buffer zones 47.

The buffer region is created by removing a portion of the earth formations surrounding the desired location of the electrode. This buffer region is formed by removing that part of the formation in which the enhanced electric field would be excessive at the operating potentials. To provide operation with a tolerable probability of breakdown, the buffer region is formed to encompass all of the electric field enhancement region around the electrode where the electric field at operating potentials exceeds the field normally sustainable by the earth formations over the period of application of the potentials as determined from the above considerations. It is also useful to utilize as a reference level the electric field remote from the enhancement region, such as the field substantially midway between the rows of electrodes. The buffer region is made big enough to encompass all of the region where the ratio of the electric field to the reference field is greater than a predetermined factor at which the probability of failure is tolerable.

The buffer region preferably includes all of the region wherein the formations might otherwise overheat. It should therefore encompass substantially all of the electric field enhancement region around the electrode where the heating rate in the earth formations would otherwise be above a predetermined level at operating potentials. The buffer region thus assures that the formations will not break down or overheat within some limit of tolerance that can be economically permitted. The predetermined level for excessive heating near the electrode may be determined from the considerations previously discussed plus the heat capacity, thermal properties, fluid flow and endothermic reactions associated with the earth formations. Control over excessive heating avoids the waste of power, undesired chemical reactions, such as product coking, and undesired changes in the earth formations, such as endothermic carbonate decomposition.

Of course, once having mitigated the effects of electric field peaking in the formations, it would not do to make matters worse again by using ineffective filling material. Therefore, the filling material that is used has certain qualities more suitable than those of the formations. To provide operation with a tolerable probability of breakdown, the dielectric material that is used has a higher breakdown level than that of the displaced formations so that the peak electric field in the buffer region is normally sustainable by the dielectric material without breakdown over the period of application of the RF energy.

The dielectric filler material should also have a relatively low power dissipation characteristic, substantially less than that of the formations, and preferably a relatively negligible power dissipation characteristic so that there is negligible heating in the dielectric material.

The electrode of appropriate size is supported in the buffer region at a desired location, preferably the location substantially minimizing the electric field at the surrounding earth formations. For the arrangement illustrated in FIG. 5, this is the eccentric location shown. The electrode size must be large enough that reasonable materials may be used for the filler. It should have a radius of curvature greater than the radius at which field enhancement exceeds a tolerable level at operating potentials. This, too, is determined from the above considerations.

Some of features of this invention may be considered in terms of its practical implementation in a hydrocarbonaceous deposit. Routinely, boreholes would be formed perhaps ten percent larger in diameter than the electrodes to permit ease of installation. Further, based on conventional electric field suppression practices, the diameters of the electrodes would be large enough to make the surface electric fields acceptably low. However, the present invention teaches that the electrode diameter in portions of the deposit should be significantly smaller than the borehole diameter, which is in contrast to the more obvious economic considerations where electrodes are slightly smaller than the boreholes. Further, in contrast to the conventional wisdom of reducing high electric fields near conductors by using the largest possible conductor radius, this invention shows that for a given borehole or chamber size, it is more effective to reduce the diameter of the contained electrode and fill the intervening void with inert material.

In accordance with the practice of this invention, the size of any mined chambers containing zones of high electric fields, such as at the tip or the end of an electrode, would be significantly enlarged. Further, in contrast to obvious methods of inserting electrodes in boreholes where the electrodes may assume random positions within the respective boreholes, the electrodes are deliberately positioned in a manner minimizing excessive heating effects near the electrodes.

Although particular preferred embodiments of the invention have been described with particularity, many modifications may be made therein with the scope of the invention. Other electrode structures may be used, and they may be disposed differently, such as horizontally. Mitigation may be effected by creating a buffer zone 47 horizontally. Mitigation may be effected by creating a buffer zone 47 around any excitor source that provides a concentration of field lines nearby.

The invention is particularly applicable to a system in which a waveguide structure is formed by electrodes disposed in earth formations, where the earth formations act as the dielectric for the waveguide, as in the triplate system illustrated. Electromagnetic energy at a selected radio frequency or at selected radio frequencies is supplied to the waveguide for controlled dissipation in the formations.

The terms "waveguide" and "waveguide structure" are used herein in the broad sense of a system of material boundaries capable of guiding electromagnetic waves. This includes the triplate transmission line formed of discrete electrodes as preferred for use in the present invention.

Unless otherwise required by the context, the term "dielectric" is used herein in the general sense of a medium capable of supporting an electric stress recovering at least a portion of the energy required to establish an electric field therein. The term thus includes the dielectric earth media considered here as imperfect dielectrics which can be characterized by both real and imaginary components, $\epsilon'$, $\epsilon''$. A wide range of such media are included wherein $\epsilon''$ can be either larger or smaller than $\epsilon'$.

"Radio frequency" will similarly be used broadly herein, unless the context requires otherwise, to mean any frequency used for radio communications. Typically this ranges upward from 10 KHz; however, frequencies as low as 45 Hz have been considered for a world-wide communications system for submarines. The frequencies currently contemplated for a large commercial oil shale facility range from 30 KHz to 3 MHz and for tar sand deposits as low as 50 Hz.

What is claimed is:

1. The method of mitigating the effects of radio frequency electric field peaking in the earth formations surrounding a conductor excited by radio frequency energy in the controlled in situ heat processing of hydrocarbonaceous earth formations, wherein radio frequency electromagnetic energy is supplied to said conductor to produce an electric field within the earth formations, said method comprising removing a portion of the earth formations to accommodate insertion of said conductor at a desired location in the earth formations and to provide a buffer region between said conductor and said surrounding earth formations; supporting said conductor at said desired location in spaced relationship to said surrounding earth formations, said buffer region encompassing all of the electric field enhancement region around said conductor where the probability of breakdown in said earth formations over the period of application of the radio frequency energy would be above a tolerable level; and filling said buffer region with dielectric material having an electric field breakdown level greater than that of the surrounding earth formation medium such that the probability of breakdown in the buffer region over the period of application of the radio frequency energy is tolerable.

2. The method according to claim 1 wherein the volume of earth formations removed is substantially greater than the volume occupied by said conductor in the region of electric field enhancement.

3. The method according to claim 1 wherein the minimum radius of curvature of said conductor is greater than the radius at which the electric field at said conductor exceeds a predetermined level at operating potentials.

4. The method according to claim 1 wherein said desired location is the location substantially minimizing said electric field at said surrounding earth formations.

5. The method of mitigating the heating effects of radio frequency electric field peaking in the earth formations surrounding a conductor excited by radio frequency energy in the controlled in situ heat processing of hydrocarbonaceous earth formations, wherein radio frequency electromagnetic energy is supplied to said conductor to produce an electric field within the earth formations, said method comprising removing a portion of the earth formations to accommodate insertion of said conductor at a desired location in the earth formations and to provide a buffer region between said conductor and said surrounding earth formations; supporting said conductor at said desired location in spaced relationship to said surrounding earth formations, said buffer region encompassing substantially all of the electric field enhancement region around said conductor where the heating rate in said surrounding earth formations would otherwise normally be above a predetermined level at operating potentials; and filling said buffer region with dielectric material having a power dissipation characteristic substantially less than that of said surrounding earth formations.

6. The method according to claim 5 wherein the volume of earth formations removed is substantially greater than the volume occupied by said conductor in the region of electric field enhancement.

7. The method according to claim 5 wherein the minimum radius of curvature of said conductor is greater than the radius at which the electric field at said conductor exceeds a predetermined level at operating potentials.

8. The method according to claim 5 wherein said desired location is the location substantially minimizing said electric field at said surrounding earth formations.

9. The method of mitigating the effects of radio frequency electric field peaking in the earth formations surrounding an electrode excited by radio frequency energy in the controlled in situ heat processing of hydrocarbonaceous earth formations, wherein radio frequency electromagnetic energy is supplied to said electrode to produce an electric field within the earth formations, said electrode being one of the excitor electrodes of a triplate array of electrodes formed of a row of excitor electrodes flanked by respective rows of guard electrodes, said method comprising removing a portion of the earth formations to accommodate insertion of said one of said excitor at a desired location in the earth formations and to provide a buffer region between said one electrode and said surrounding earth formations; supporting said one electrode at said desired location in spaced relationship to said surrounding earth formations, said buffer region encompassing all of the electric field enhancement region around said one electrode where the ratio of said electric field to the field existing in said earth formations substantially midway between said row of excitor electrodes and a respective flanking row of guard electrodes exceeds a predetermined factor at which the probability of breakdown is tolerable; and filling said buffer region with dielectric material having an electric field breakdown level greater than that of the surrounding earth formation medium such that the probability of breakdown in the buffer region over the period of application of the radio frequency energy is tolerable.

10. The method according to claim 9 wherein said buffer region is formed around an end of said one electrode.

11. The method according to claim 9 wherein said one electrode and said buffer region are substantially cylindrical and parallel and said one electrode is an end electrode in said row of excitor electrodes and is supported eccentrically of the respective said buffer region in the direction of the adjacent excitor electrode in said row.

12. The method according to claim 9 wherein the volume of earth formations removed is substantially greater than the volume occupied by said one electrode in the region of electric field enhancement.

13. The method according to claim 9 wherein the minimum radius of curvature of said one electrode is greater than the radius at which the electric field at said one electrode exceeds a predetermined level at operating potentials.

14. The method according to claim 9 wherein said desired location is the location substantially minimizing said electric field at said surrounding earth formations.

15. The method of mitigating the heating effects of radio frequency electric field peaking in the earth formations surrounding an electrode excited by radio frequency energy in the controlled in situ heat processing of hydrocarbonaceous earth formations, wherein radio frequency electromagnetic energy is supplied to said electrode to produce an electric field within the earth formations, said electrode being one of the electrodes of a triplate array of electrodes formed of a row of electrodes flanked by respective rows of guard electrodes, said method comprising removing a portion of the earth formations to accommodate insertion of one of said electrodes at a desired location in the earth formations and to provide a buffer region between said one electrode and said surrounding earth formations, supporting said one electrode at said desired location in spaced relationship to said surrounding earth formations, said buffer region encompassing substantially all of the electric field enhancement region around said one electrode where the heating rate in said surrounding earth formations would otherwise normally be above a predetermined level at operating potentials; and filling said buffer region with dielectric material having a power dissipation characteristic substantially less than that of said surrounding earth formations.

16. The method according to claim 15 wherein said buffer region is formed around an end of said one electrode.

17. The method according to claim 15 wherein said one electrode and said buffer region are substantially cylindrical and parallel and said one electrode is an end electrode in said row of excitor electrodes and is supported eccentrically of the respective said buffer region in the direction of the adjacent excitor electrode in said row.

18. The method according to claim 15 wherein the volume of earth formations removed is substantially greater than the volume occupied by said one electrode in the region of electric field enhancement.

19. The method according to claim 15 wherein the minimum radius of curvature of said one electrode is greater than the radius at which the electric field at said one electrode exceeds a predetermined level at operating potentials.

20. The method according to claim 15 wherein said desired location is the location substantially minimizing said electric field at said surrounding earth formations.

21. The method according to any one of claims 1 to 20 wherein the real part of the permittivity of said filling dielectric material is substantially equal to that of the surrounding earth formations over a substantial portion of the range of temperatures in said surrounding earth formations during said heat processing.

22. The method according to claim 21 wherein the power dissipation characteristic of said filling dielectric material is substantially less than that of said surrounding earth formations over substantially all of the range of temperatures incurred during said heat processing.

23. The method according to claim 21 wherein the power dissipation characteristic of said filling dielectric material is substantially negligible.

24. The method according to any one of claims 1 to 20 wherein the power dissipation characteristic of said filling dielectric material is substantially less than that of said surrounding earth formations over substantially all of the range of temperatures incurred during said heat processing.

25. The method according to any one of claims 1 to 20 wherein the loss tangent of said filling dielectric material is substantially negligible.

26. Structure for mitigating the effects of radio frequency electric field peaking in the earth formations surrounding a conductor excited by radio frequency energy for the controlled in situ heat processing of hydrocarbonaceous earth formations, wherein radio frequency electromagnetic energy is supplied to the conductor to produce an electric field within the earth formations, said structure comprising a conductor having a minimum radius of curvature greater than the radius at which the enhancement of the electric field at said conductor exceeds a tolerable level at operating potentials; means for supporting said conductor at a desired location in the earth formations in spaced relationship to surrounding earth formations to provide a buffer region between said conductor and said surrounding earth formations, said buffer region encompassing all of the electric field enhancement region around said conductor where the probability of breakdown in said earth formations over the period of application of the radio frequency energy would be above a tolerable level; and dielectric material filling said buffer region, said dielectric material having an electric field breakdown level greater than that of the surrounding earth formation medium such that the probability of breakdown in the buffer region over the period of application of the radio frequency energy is tolerable.

27. Structure according to claim 26 wherein the volume of said buffer region is large relative to the volume occupied by said conductor in the region of electric field enhancement.

28. Structure according to claim 26 wherein said desired location is the location substantially minimizing said electric field at said surrounding earth formations.

29. Structure for mitigating the heating effects of radio frequency electric field peaking in the earth formations surrounding a conductor excited by radio frequency energy for the controlled in situ heat processing of hydrocarbonaceous earth formations, wherein radio frequency electromagnetic energy is supplied to the conductor to produce an electric field within the earth formations, said structure comprising a conductor having a minimum radius of curvature greater than the radius at which the enhancement of the electric field at said conductor exceeds a tolerable level at operating potentials; means for supporting said conductor at a desired location in the earth formations in spaced relationship to surrounding earth formations to provide a buffer region between said conductor and said surrounding earth formations, said buffer region encompassing substantially all of the electric field enhancement region around said conductor where the heating rate in said surrounding earth formations would otherwise normally be above a predetermined level at operating potentials; and dielectric material filling said buffer region, said dielectric material having a power dissipation characteristic substantially less than that of said surrounding earth formations.

30. Structure according to claim 29 wherein the volume of said buffer region is large relative to the volume occupied by said conductor in the region of electric field enhancement.

31. Structure according to claim 29 wherein said desired location is the location substantially minimizing said electric field at said surrounding earth formations.

32. Structure for mitigating the effects of radio frequency electric field peaking in the earth formations surrounding an electrode excited by radio frequency energy for the controlled in situ heat processing of hydrocarbonaceous earth formations, wherein radio frequency electromagnetic energy is supplied to said electrode to produce an electric field within the earth formations, said electrode being one of the electrodes of a triplate array of electrodes formed of a row of excitor electrodes flanked by respective rows of guard electrodes, said structure comprising one of said electrodes having a minimum radius of curvature greater than the radius at which the enhancement of the electric field at said one electrode exceeds a tolerable level at operating potentials; means for supporting said one of said electrodes at a desired location in the earth formations in spaced relationship to surrounding earth formations to provide a buffer region between said one electrode and said surrounding earth formations, said buffer region encompassing all of the electric enhancement region around said one electrode where the ratio of said electric field to the field existing in said earth formations substantially midway between said row of excitor electrodes and a respective flanking row of guard electrodes exceeds a predetermined factor at which the probability of breakdown is tolerable; and dielectric material filling said buffer region, said dielectric material having an electric field breakdown level greater than that of the surrounding earth formation medium such that the probability of breakdown in the buffer region over the period of application of the radio frequency energy is tolerable.

33. Structure according to claim 32 wherein said buffer region is formed around an end of said one electrode.

34. Structure according to claim 32 wherein said one electrode and said buffer region are substantially cylindrical and parallel and said one electrode is an end electrode in said row of excitor electrodes and is supported eccentrically of the respective said buffer region in the direction of the adjacent excitor electrode in said low.

35. Structure according to claim 32 wherein the volume of said buffer region is large relative to the volume occupied by said one electrode in the region of electric field enhancement.

36. Structure according to claim 32 wherein said desired location is the location substantially minimizing said electric field at said surrounding earth formations.

37. Structure for mitigating the heating effects of radio frequency electric field peaking in the earth formations surrounding an electrode excited by radio frequency energy for the controlled in situ heat processing of hydrocarbonaceous earth formations, wherein radio frequency electromagnetic energy is supplied to said electrode to produce an electric field within the earth formations, said electrode being one of the electrodes of a triplate array of electrodes formed of a row of excitor electrodes flanked by respective rows of guard electrodes, said structure comprising one of said electrodes having a minimum radius of curvature greater than the radius at which the enhancement of the electric field at said one electrode exceeds a tolerable level at operating potentials; means for supporting said one of said electrodes at a desired location in the earth formations in spaced relationship to surrounding earth formations to provide a buffer region between said one electrode and said surrounding earth formations, said buffer region encompassing substantially all of the electric field enhancement region around said one electrode where the heating rate in said surrounding earth formations would otherwise normally be above a predetermined level at operating potentials, and dielectric material filling said buffer region, said dielectric material having a power dissipation characteristic substantially less than that of said surrounding earth formations.

38. Structure according to claim 32 wherein said buffer region is formed around an end of said one electrode.

39. Structure according to claim 37 wherein said one electrode and said buffer region are substantially cylindrical and parallel and said one electrode is an end electrode in said row of excitor electrodes and is supported eccentrically of the respective said buffer region in the direction of the adjacent excitor electrodes in said row.

40. Structure according to claim 37 wherein the volume of said buffer region is large relative to the volume occupied by said one electrode in the region of electric field enhancement.

41. Structure according to claim 37 wherein said desired location is the location substantially minimizing said electric field at said surrounding earth formations.

42. Structure according to any one of claims 26, 27, 28, 29, 30, 31 to 35, 36, 37 to 40, 41 and 43 to 47 wherein the loss tangent of said filling dielectric material is substantially negligible.

43. Structure for mitigating the effects of radio frequency electric field peaking in the earth formations surrounding an electrode excited by radio frequency energy for the controlled in situ heat processing of hydrocarbonaceous earth formations, wherein radio frequency electromagnetic energy is supplied to said electrode to produce an electric field within the earth formations, said electrode being one of the electrodes of a triplate array of electrodes formed of a row of excitor electrodes flanked by respective rows of guard electrodes, said structure comprising means for supporting one of said electrodes at a desired location in the earth formations in spaced relationship to surrounding earth formations to provide a buffer region between said one electrode and said surrounding earth formations, said buffer region encompassing all of the electric enhancement region around said one electrode where the ratio of said electric field to the field existing in said earth formations substantially midway between said row of excitor electrodes and a respective flanking row of guard electrodes exceeds a predetermined factor at which the probability of breakdown is tolerable, said one electrode and said buffer region being substantially cylindrical and parallel and said one electrode being an end electrode in said row of excitor electrodes and being supported eccentrically of the respective said buffer region in the direction of the adjacent excitor electrode in said row; and dielectric material filling said buffer region, said dielectric material having an electric field breakdown level greater than that of the surrounding earth formation medium such that the probability of breakdown in the buffer region over the period of application of the radio frequency energy is tolerable.

44. Structure according to claim 43 wherein the volume of said buffer region is large relative to the volume occupied by said one electrode in the region of electric field enhancement.

45. Structure according to claim 43 wherein said desired location is the location substantially minimizing said electric field at said surrounding earth formations.

46. Structure for mitigating the heating effects of radio frequency electric field peaking in the earth formations surrounding an electrode excited by radio frequency energy for the controlled in situ heat processing of hydrocarbonaceous earth formations, wherein radio frequency electromagnetic energy is supplied to said electrode to produce an electric field within the earth formations, said electrode being one of the electrodes of a triplate array of electrodes formed of a row of excitor electrodes flanked by respective rows of guard electrodes, said structure comprising means for supporting said one of said electrodes at a desired location in the earth formations in spaced relationship to surrounding earth formations to provide a buffer region between said one electrode and said surrounding earth formations, said buffer region encompassing substantially all of the electric field enhancement region around said one electrode where the heating rate in said surrounding earth formations would otherwise normally be above a predetermined level at operating potentials, said one electrode and said buffer region being substantially cylindrical and parallel and said one electrode being an end electrode in said row of excitor electrodes and being supported eccentrically of the respective said buffer region in the direction of the adjacent excitor electrode in said row; and dielectric material filling said buffer region, said dielectric material having a power dissipation characteristic substantially less than that of said surrounding earth formations.

47. Structure according to claim 46 wherein the volume of said buffer region is large relative to the volume occupied by said one electrode in the region of electric field enhancement.

48. Structure according to any one of claims 26, 27, 28, 29, 30, 31 to 35, 36, 37 to 40, 41 and 43 to 47 wherein the real part of the permittivity of said filling dielectric material is substantially equal to that of the surrounding earth formations over a substantial portion of the range of temperatures in said surrounding earth formations during said heat processing.

49. Structure according to claim 48 wherein the power dissipation characteristic of said filling dielectric material is substantially less than that of said surrounding earth formations over substantially all of the range of temperatures incurred during said heat processing.

50. Structure according to any one of claims 26, 27, 28, 29, 30, 31 to 35, 36, 37 to 40, 41 and 43 to 47 wherein the power dissipation characteristic of said filling dielectric material is substantially less than that of said surrounding earth formations over substantially all of the range of temperatures incurred during said heat processing.

51. Structure according to claim 46 wherein said desired location is the location substantially minimizing said electric field at said surrounding earth formations.

* * * * *

UNITED STATES PATENT AND TRADEMARK OFFICE

CERTIFICATE OF CORRECTION

PATENT NO. : 4,476,926

DATED : October 16, 1984

INVENTOR(S) : Bridges et al.

It is certified that error appears in the above-identified patent and that said Letters Patent is hereby corrected as shown below:

Column 5, line 12, change "The" to --Aside from the field mitigating structure of the present invention, the--.

Column 7, line 20, change "14cand" to --14c and--.

Signed and Sealed this

Second Day of July 1985

[SEAL]

*Attest:*

DONALD J. QUIGG

*Attesting Officer* *Acting Commissioner of Patents and Trademarks*